US010828751B2

(12) United States Patent
Abel et al.

(10) Patent No.: US 10,828,751 B2
(45) Date of Patent: Nov. 10, 2020

(54) SCREWDRIVER HAVING A CHANGEABLE DIRECTION FREEWHEEL LOCK

(71) Applicant: Wera Werkzeuge GmbH, Wuppertal (DE)

(72) Inventors: Michael Abel, Radevormwald (DE); Ralf-Richard Richter, Wuppertal (DE)

(73) Assignee: Wera Werkzeuge GmbH, Wuppertal (DE)

( * ) Notice: Subject to any disclaimer, the term of this patent is extended or adjusted under 35 U.S.C. 154(b) by 211 days.

(21) Appl. No.: 16/072,779

(22) PCT Filed: Jan. 11, 2017

(86) PCT No.: PCT/EP2017/050456
§ 371 (c)(1),
(2) Date: Jul. 25, 2018

(87) PCT Pub. No.: WO2017/129402
PCT Pub. Date: Aug. 3, 2017

(65) Prior Publication Data

US 2019/0030689 A1 Jan. 31, 2019

(30) Foreign Application Priority Data

Jan. 27, 2016 (DE) ..... 10 2016 101 400

(51) Int. Cl.
*B25B 13/46* (2006.01)
*B25B 13/04* (2006.01)

(52) U.S. Cl.
CPC ..... *B25B 13/463* (2013.01); *B25B 13/04* (2013.01); *B25B 13/468* (2013.01)

(58) Field of Classification Search
CPC ..... B25B 13/463; B25B 13/468; B25B 13/04
See application file for complete search history.

(56) References Cited

U.S. PATENT DOCUMENTS

| | | | | |
|---|---|---|---|---|
| 6,584,875 | B1 | 7/2003 | Deng | |
| 7,089,830 | B2 * | 8/2006 | Hu | B25B 13/463 81/63.1 |
| RE44,655 | E * | 12/2013 | Ross | B25B 13/463 81/62 |
| 10,118,278 | B2 * | 11/2018 | Thompson | B25B 13/04 |
| 10,322,497 | B2 * | 6/2019 | Thompson | F16D 41/16 |
| 2006/0185479 | A1 | 8/2006 | Hsieh | |
| 2012/0060652 | A1 | 3/2012 | Gapp et al. | |
| 2013/0145906 | A1 | 6/2013 | Hu | |
| 2013/0291688 | A1 | 11/2013 | Hu | |
| 2014/0311300 | A1 | 10/2014 | Chen | |

* cited by examiner

*Primary Examiner* — David B. Thomas
(74) *Attorney, Agent, or Firm* — Whitmyer IP Group LLC

(57) ABSTRACT

A screwdriver having a changeable direction freewheel lock, having a drive output member that is mounted so as to be rotatable about an axis in a bearing eye of a drive input member and has a circumferential toothing and a drive-output profile portion, and locking members that are inserted in a pocket of the drive input member and each have a locking toothing for engaging with the circumferential toothing in a manner preventing rotation. What is essential is that the locking members are two bodies that are movable relative to one another, can be displaced in an articulated manner with respect to one another and each have a switching extension which project into the same switching recess of a switching member.

16 Claims, 7 Drawing Sheets

SCREWDRIVER HAVING A CHANGEABLE DIRECTION FREEWHEEL LOCK

TECHNICAL FIELD

The invention pertains to a screwing tool with a directionally reversible freewheel lock, wherein said screwing tool comprises a drive output member, which is mounted in a bearing eye of a drive input member so as to be rotatable about an axis and features a circumferential toothing and a drive output profile section, as well as locking members, which are inserted into a pocket of the drive input member and respectively feature a locking toothing for engaging into the circumferential toothing in a rotationally locking manner.

BACKGROUND

A screwing tool of this type in the form of a ratchet wrench is described in DE 10 2014 113 758 A1. In this case, a drive input member is formed by an elongate body that has an open-end wrench profile on one end and a box wrench profile on the other end. The drive output profile (box wrench profile) is formed by a drive output member that is inserted into a bearing eye in a rotatable manner and features a circumferential toothing. A locking body is provided and features two locking toothing sections, which respectively engage into the circumferential toothing in one of the two switching positions in order to block the rotatability of the drive output member relative to the drive input member in one of the two rotating directions. The locking body forms a first locking member, which in a first switching position of the switching member is inserted in a locking interstice that lies opposite of a second locking interstice. The locking body can be displaced within the pocket by rotating the switching member such that a second locking member is inserted into the second locking interstice. The two locking members are integrally connected to one another.

SUMMARY

The invention is based on the objective of advantageously enhancing the directionally reversible freewheel lock in terms of its use.

This objective is attained with the invention specified in the claims. The dependent claims not only represent advantageous enhancements of the invention but also independent solutions to the objective.

It is initially and essentially proposed that the locking members are formed by two bodies that can be displaced relative to one another. The locking members are preferably not integrally connected to one another. The locking members can preferably be displaced relative to one another in an articulated manner. To this end, it would be conceivable to provide hook-type projections that engage into one another. Each locking member has a locking toothing that extends along a circular arc line, the center of which coincides with the center of the circumferential toothing in the engaged position. It is proposed that only one of the two switching members respectively engages into the circumferential toothing with its locking toothing in both switching positions, in which the drive output member is respectively rotatable in one rotating direction, but blocked in the other rotating direction. The locking members are essentially realized in a folding-symmetric manner. Each locking member may feature a switching extension, wherein both switching extensions preferably protrude into the same switching recess of a switching member. A spring-loaded control flank may be arranged within the switching member. The control flank may be formed by a curved surface of a switching plunger. The switching plunger may be inserted into a bore of the switching member and acted upon by a switching spring. The switching spring may in turn be supported on a detent plunger that cooperates with a detent cam, which in the two switching positions respectively engages into a detent recess. The detent cam may be integrally connected to the detent plunger. However, the detent cam is preferably formed by a detent ball that is acted upon by the detent plunger. The switching member may be inserted into a bore of the drive input member so as to be rotatable about an axis extending parallel to the rotational axis. During the directional reversal of the freewheel lock, the switching member is rotated about its axis. In the process, it displaces the two locking members, which are preferably coupled to one another, in the azimuthal direction in a pocket of the drive input member that forms two locking interstices lying opposite of one another in the azimuthal direction, wherein each locking interstice is formed by a wall of the pocket and by a section of the circumferential toothing. In this case, the section of the wall of the pocket is inclined or a curved relative to the circumferential toothing in such a way that an imaginary extension of the pocket wall intersects the circumferential toothing. A contact flank of the locking body, which extends in a wedge-shaped manner to the locking toothing, is supported on this wall. In each of two switching positions, the drive output member respectively is freely rotatable in a freewheeling direction and rotationally blocked in a locking direction. When the drive output member is acted upon with a torque in the locking direction, the locking member is pressed into the respective locking interstice by the teeth of the locking toothing engaging into the circumferential toothing. In this case, the contact flank of the locking body rests against the wall of the locking interstice. During the displacement of the locking body from one switching position into the other switching position, the ends of the switching extensions slide over the curved surface of the switching plunger. The two switching members are in the process displaced relative to one another in an articulated manner such that both locking toothings of the locking bodies are simultaneously engaged with the circumferential toothing in an intermediate position, in which the curved surface of the switching plunger engages on the free ends of the switching extensions. During the switch-over, the switching plunger is displaced in a radial direction referred to the rotational axis of the switching member and thereby tensions the switching spring. In their plane of motion that extends perpendicular to the rotational axis, the switching members have an essentially L-shaped contour, wherein one L-limb forms an arm, which forms the locking toothing and the contact flank, and an arm of the other L-limb extending essentially transverse thereto forms the switching extension. The switching extension forms an arm with longitudinal sides that point away from one another and transform into one another in a rounded or pointed manner on their ends. These end regions of the longitudinal flanks of the switching extensions are acted upon by the control flank, which is preferably formed by the curved surface of the switching plunger. In the switching positions, the longitudinal flank of the locking extension pointing away from the locking toothing is acted upon by the locking locking member. The non-locking locking member acts upon the longitudinal flank of the switching extension pointing toward the locking toothing. As a result, the locking toothing of the non-locking locking member is acted upon in the direction away from the circumferential toothing and the locking toothing of the locking locking member is acted upon into the circumferential toothing. During the switch-over, the control flank essentially engages in the crown region of the two longitudinal flanks such that a relative rotation of the two locking members, during which both locking toothings simultaneously engage into the circumferential toothing, takes place in an intermediate position. The two locking members form an overlapping region, in which the hook-type projections engaging into one another are arranged. The hook-type projections engage into one another with such a pivoting motion clearance that the locking members can be pivoted from one operating position, in which the locking toothings lie on a common circular arc line, into another operating position, in which the two centers of the locking toothings are spaced apart from one another. In the operating position, in which the locking toothings extend on a common circular arc line, the two switching extensions lie congruently on top of one another. In the other operating position, the switching extensions are offset relative to one another such that they can be moved into a congruent position in a scissor joint-like manner due to a motion toward one another, wherein the joint is formed by the hook-type projections engaging into one another. The switching extensions are sections of the overlapping regions.

BRIEF DESCRIPTION OF THE DRAWINGS

The invention is described in greater detail below with reference to exemplary embodiments. In the drawings.

DETAILED DESCRIPTION

Figure 1:
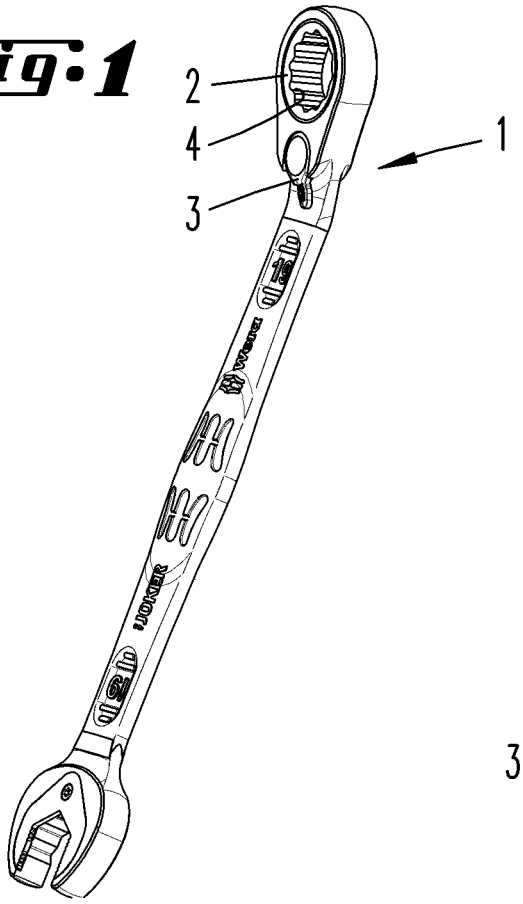
FIG. 1 shows a perspective representation of a screwing tool in the form of a wrench with an open-end profile on one end and a box profile on the opposite end.
Figure 2:
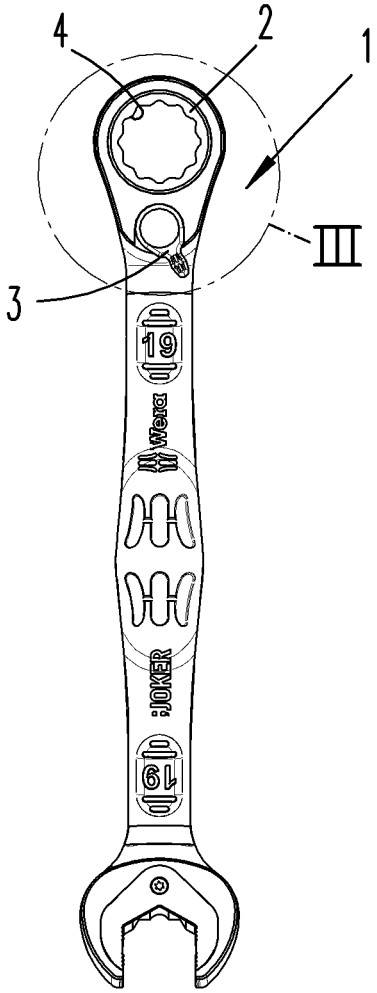
FIG. 2 shows a top view of the screwing tool.

The screwing tool illustrated in the drawings has an external shape of the type illustrated and described in DE 10 2014 113 758 A1. The screwing tool comprises an elongate drive input member 1 that has an open-end wrench profile on one free end and a bearing eye 6 on its opposite free end. An annular drive output member 2 with a drive output profile in the form of a polygonal socket profile is rotatably mounted in the bearing eye 6. However, the drive output member 2 may also have a different shape and, for example, form a drive output polygon, which then in turn forms the drive output profile. The drive output member 2 features a circumferential toothing 5 with a plurality of teeth that point radially outward and the linear tooth flanks of which are realized in a roof-like manner.

A pocket is located in a circumferential region of the bearing eye 6 and forms two locking interstices 17, 27 that lie opposite of one another in the circumferential direction. The locking interstices 17, 27 are formed by walls 18, 28 of the pocket, which extend from a bearing bore for mounting a switching member 3 up to the radially inner edge of the bearing eye 6 in an arc-shaped manner and an extension of which intersects the circumferential toothing 9.

Two locking members 10, 20 formed by separate bodies are mounted in the pocket 17, 27 and form locking bodies that contact one another and sectionally also lie on top of one another in overlapping regions 15, 25, but are assigned to one another in a pivotable manner. The locking members 10, 20 are realized folding-symmetrical to one another. They have an L-shape that extends in the plane of motion, wherein one L-limb is formed by an arm 19, 29 and a second L-limb is formed by a switching extension 13, 23. The two arms 19, 29 point away from one another. The switching extensions 13, 23 are arranged adjacent to the respective overlapping regions 15, 25 and overlap one another.

The two locking members 10, 20 are coupled to one another in an articulated manner. To this end, they respectively form a hook-type projection 32 in the overlapping region 15, 25. The two hook-type projections respectively engage into a recess. The two hook-type projections 32 have a sufficient motion clearance for pivoting the locking members 10, 20 relative to one another.

The switching extension 13, 23 forms a longitudinal flank that points toward the arm 19, 29 and transforms into a concavity 16, 26, adjacent to which a contact flank 12, 22 is arranged. The arm 19, 29 has two longitudinal flanks that essentially extend parallel to one another and transform into one another in a rounded or pointed manner on the free end 14, 24 of the switching extension 13, 23.

The contact flank 12, 22 transforms into a locking toothing 11, 21 by forming an acute angle. The locking toothing 11, 21 respectively extends on a circular arc line, the radius of which corresponds to the radius of the circular arc line, along which the circumferential toothing 5 extends. The locking toothing 11, 21 extends as far as into the overlapping region 15, 25, in which sections of the switching members 10, 20, which also include the switching extensions 13, 23, lie on top of one another in the direction of the axis a.

The switching extensions 13, 23 engage into a switching recess 30 in the form of a radial opening of a cavity of the switching member 3. A switching plunger 7 is located within the cavity of the switching member 3 and has a curved surface 7', which points radially outward and forms a control flank. A switching spring 8 is supported on a detent plunger 9 and acts upon the switching plunger 7 in the radially outward direction. The detent plunger 9 acts upon a detent ball 33, which can engage into one of two detent recesses 31 in order to rotationally inhibit the switching member 3 in one of its two switching positions. The free end 14, 24 of the switching extension 13, 23 forms crown surfaces that point away from one another and on which the switching flank 7' engages in order to exert a spring force upon the locking member 10, 20.

Figure 3:
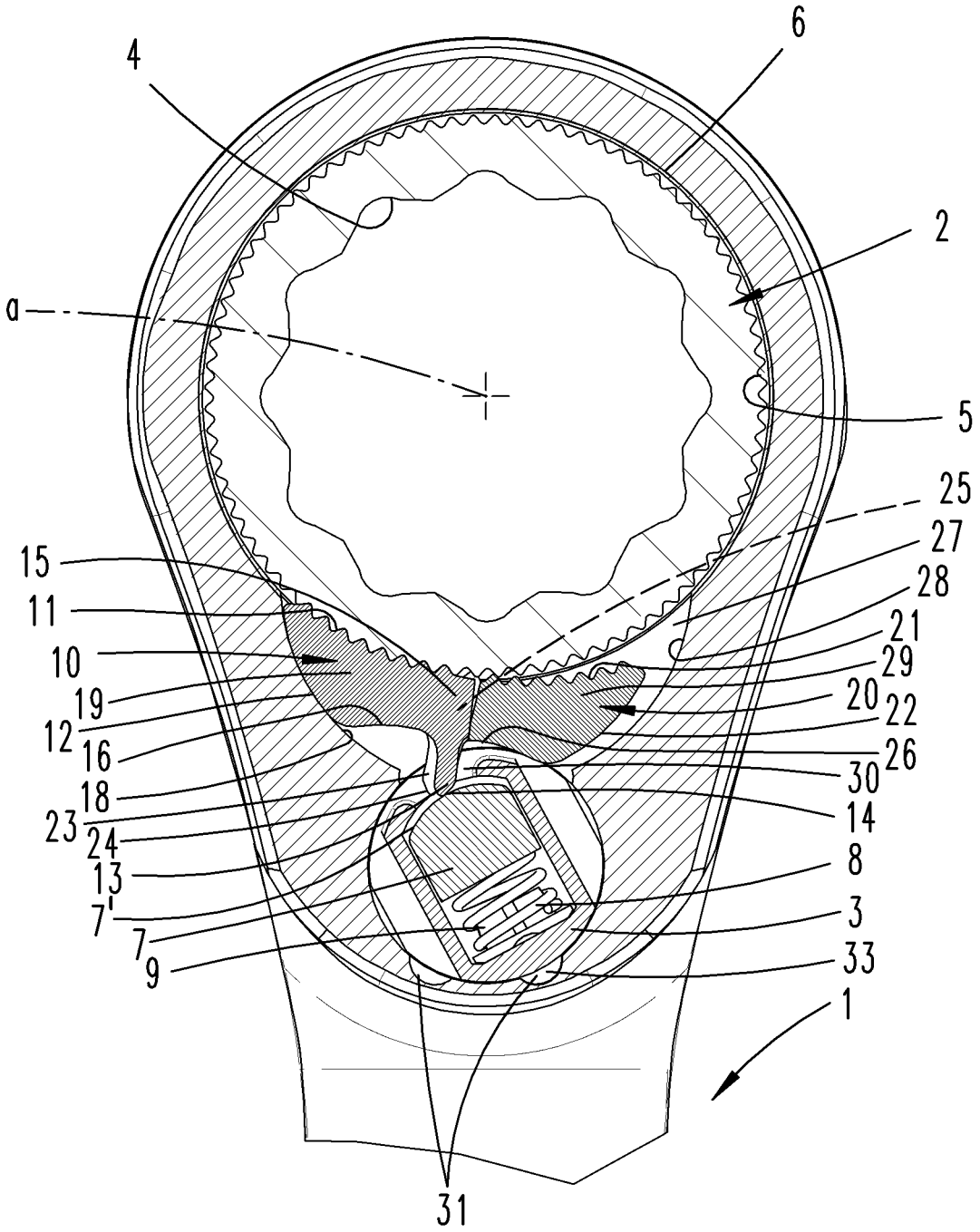
FIG. 3 shows the enlarged detail III in FIG. 2 and is broken open in such a way that the freewheel lock is visible, wherein the freewheel lock assumes such an operating position that a drive output member 2 can be rotated relative to a drive input member 1 in the counterclockwise direction.

In a first switching position, in which the locking member 10 is located in the locking interstice 17 and rests against the wall 18 of the locking interstice 18 with its contact flank 12, the locking toothing 11 of the locking member 10 engages into the circumferential toothing 5 (see FIG. 3). When a torque is exerted upon the drive output member 2 in the clockwise direction, the drive output member 2 cannot rotate within the bearing eye 6. The locking member 10 becomes wedged in the locking interstice 17.

The control flank 7' acts upon a crown flank of the free end 14 of the switching extension 13 in the direction of the locking interstice 17. In this case, the control flank 7' engages on the longitudinal flank of the switching extension 13 that points away from the locking toothing 11.

The control flank 7' engages on a crown flank of the free end 24 of the switching member 20 in such a way that the locking toothing 21 of the locking member 20 does not engage into the circumferential toothing 5.

When a torque is exerted upon the drive output member 2 in the counterclockwise direction, the locking member 10 can be displaced in the direction out of the locking interstice 17, wherein the contact flank 12 slides along the wall 18 and the locking toothing 11 disengages from the circumferential toothing 5 such that the drive output member 2 can be freely rotated relative to the drive input member 1.

For the switch-over, the switching member 3 is rotated in the clockwise direction, wherein the free end 14, 24 of the switching extension 13, 23 of the locking member 10, 20 slides along the control flank 7'. In an intermediate position, the crown regions of the ends 14, 24 are acted upon by the control flank 7' in such a way that the locking members 10, 20 are displaced relative to one another in an articulated manner. In this intermediate position, both locking toothings 11, 21 engage into the circumferential toothing 5. In this case, the two locking members 10, 20 pivot about their articulated connection, which is in the exemplary embodiment formed by the two hook-type projections 32 engaging into one another, until the switching extensions 13, 23 reach a congruently overlapping position.

Figure 4:
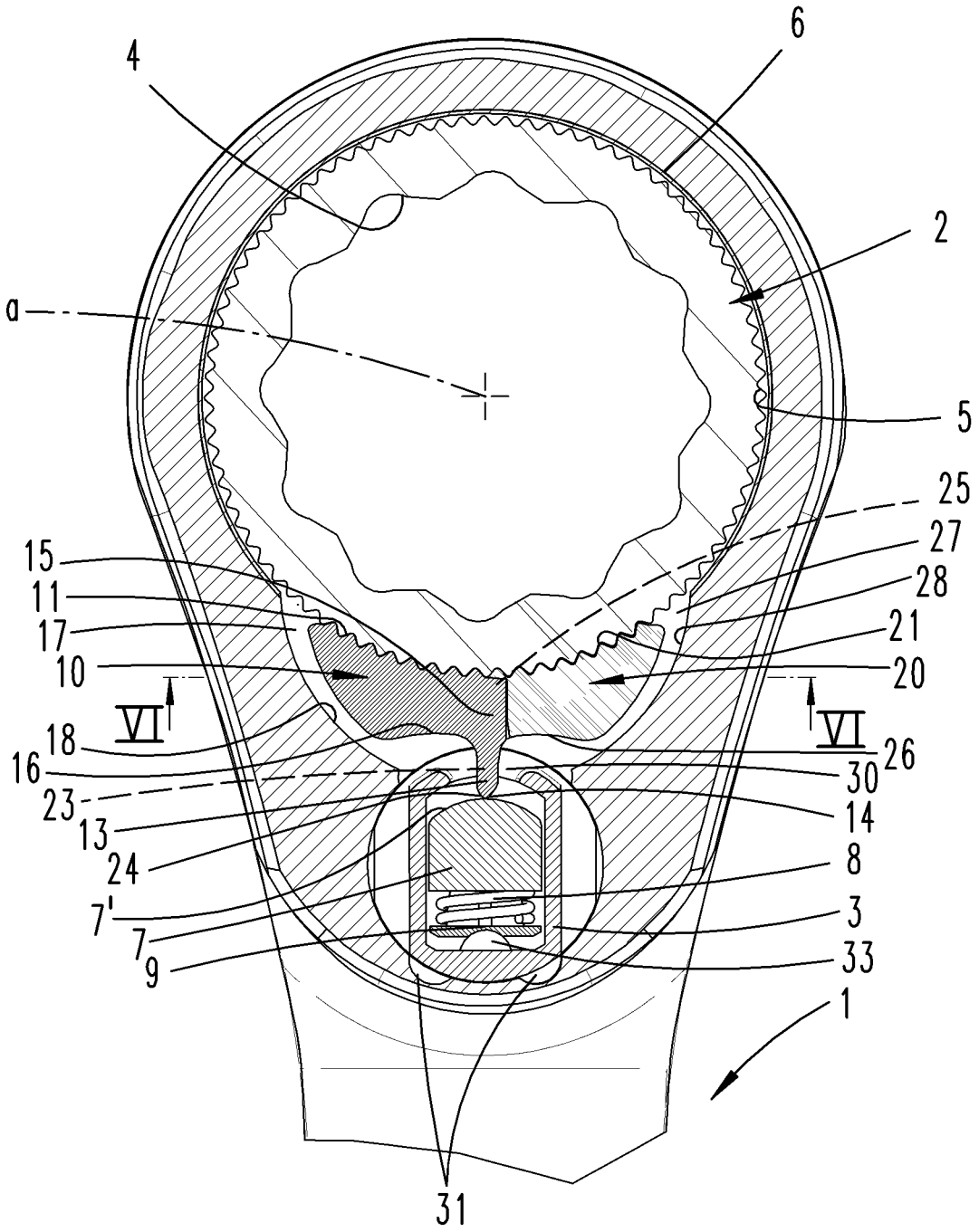
FIG. 4 shows a representation according to FIG. 3, however, when a switching member 3 is switched into an intermediate position.

Based on this intermediate position illustrated in FIG. 4, in which the locking toothings 11, 21 of both locking members 10, 20 are simultaneously engaged with the circumferential toothing 5, the switching member 3 is for the switch-over additionally displaced in the clockwise direction and now acts upon the longitudinal flank of the arm 29 of the locking member 20 pointing away from the locking toothing 21 and the longitudinal flank of the arm 19 of the locking member 10 pointing toward the locking toothing 11. This once again causes an articulated motion of the two locking members 10, 20 relative to one another. In the process, the locking toothing 11 of the locking member 10 disengages from the circumferential toothing 5.

Figure 5:
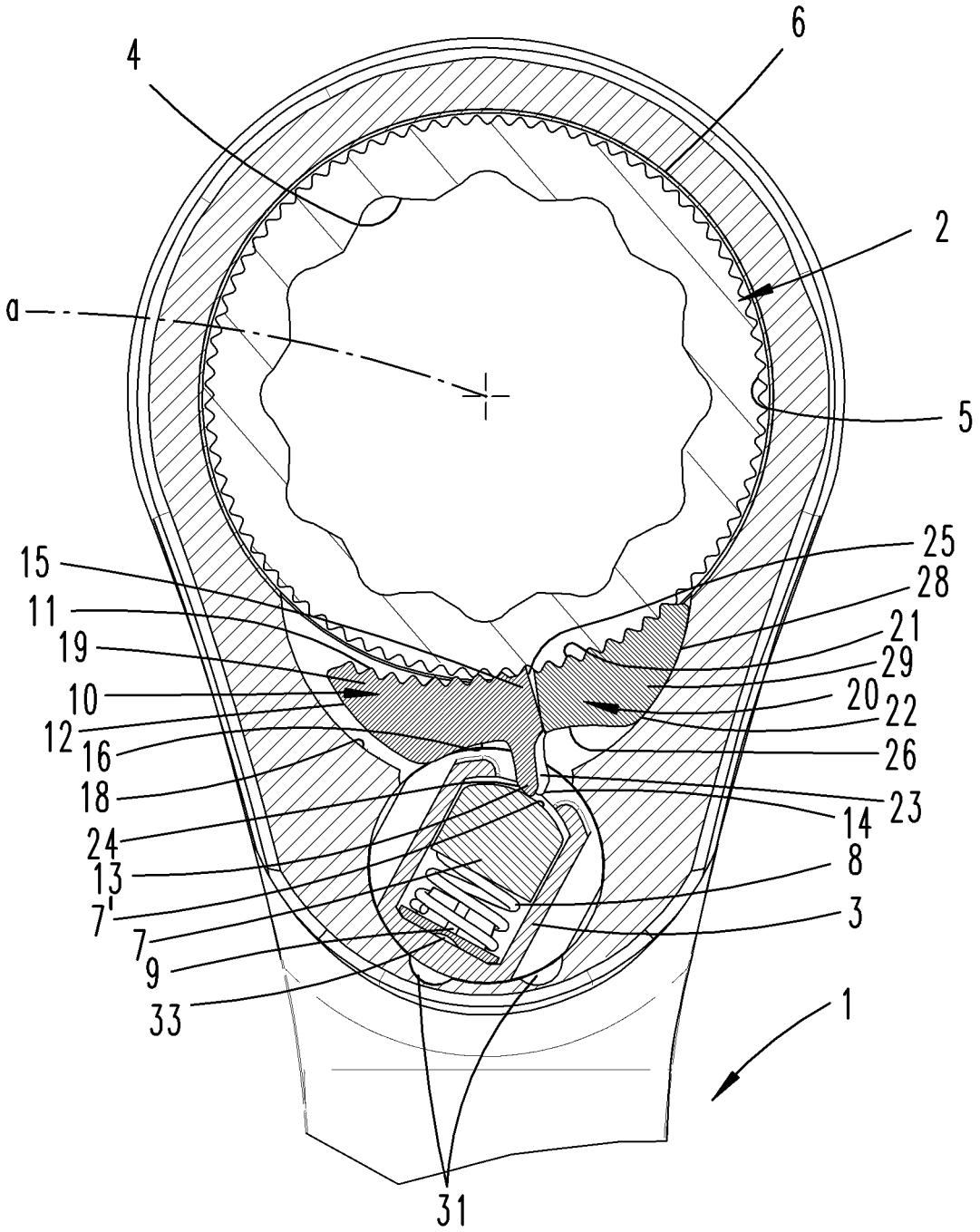
FIG. 5 shows a representation according to FIG. 3, in which the freewheel lock allows a rotation of the drive output member 2 relative to the drive input member 1 in the clockwise direction.
Figure 6:
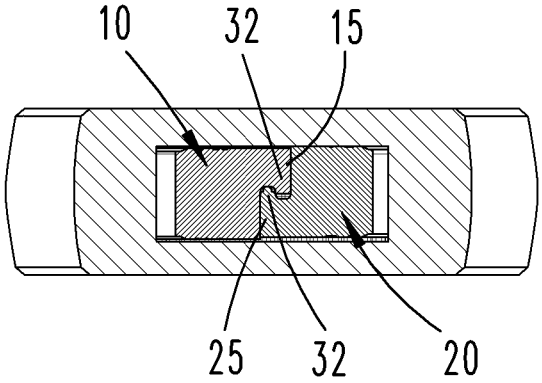
FIG. 6 shows the section along the line VI-VI in FIG. 4.
Figure 7:
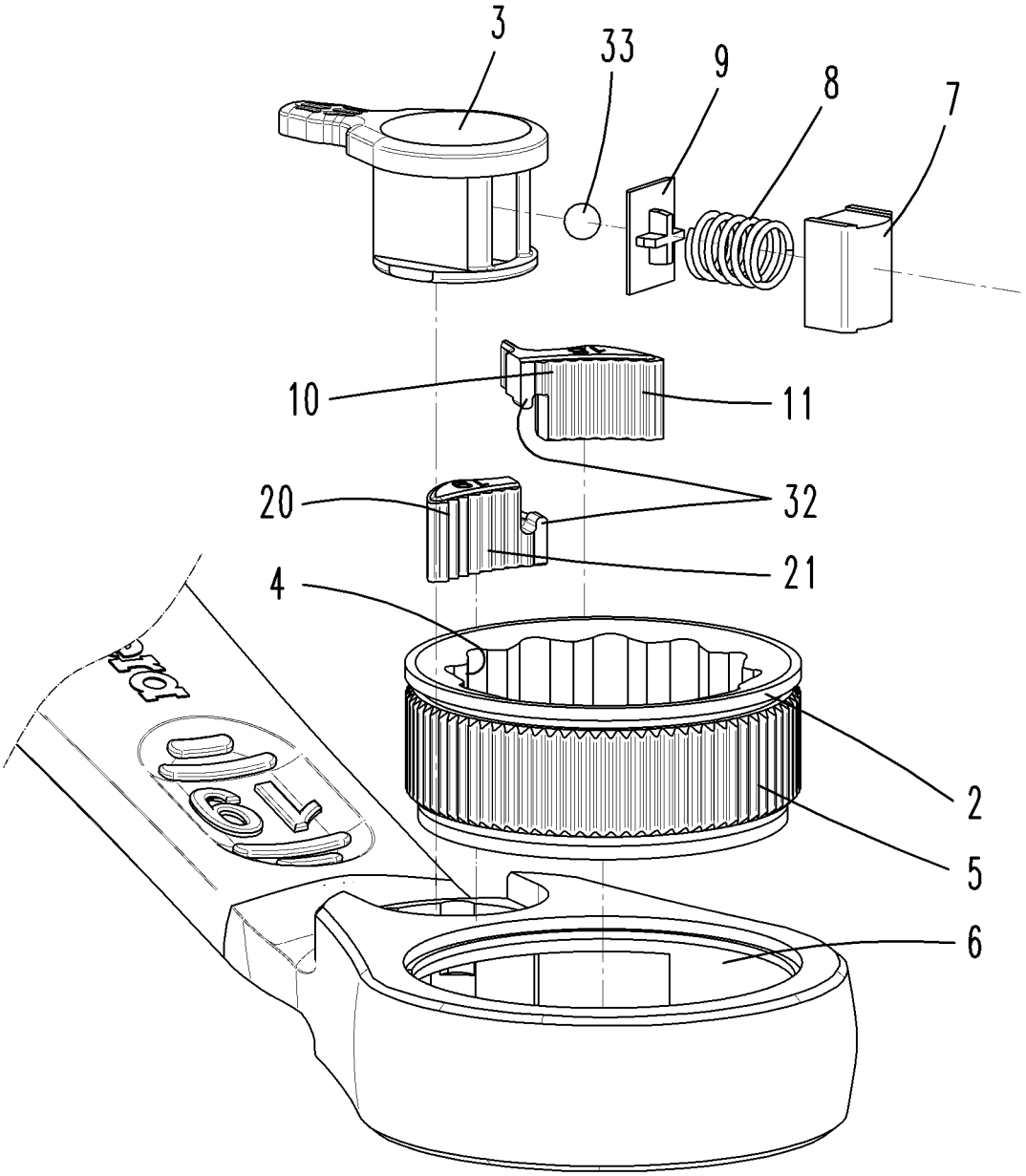
FIG. 7 shows a first exploded view of the elements of the freewheel lock.
Figure 8:
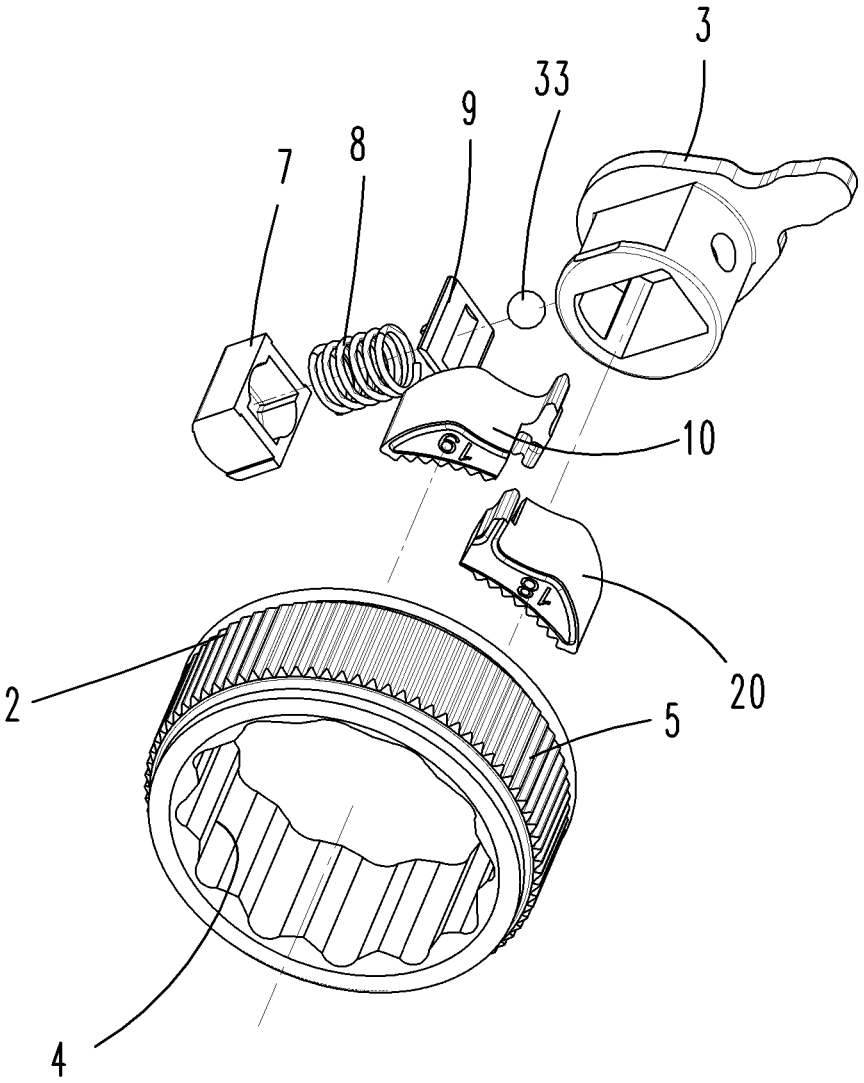
FIG. 8 shows a second exploded view of the elements of the freewheel lock.

In the end position, the locking member 20 is acted upon into the associated locking interstice 27 by the force of the switching spring 8 such that the contact flank 22 is supported on the wall 28 of the locking interstice 27 and the locking toothing 21 of the locking member 20 engages into the circumferential toothing 5. The locking toothing 11 of the locking member 10, which in this switching position performs a non-locking function, is located outside the circumferential toothing 5 (see FIG. 5).

The two locking members 10, 20 are designed in such a way that the two locking toothings 11, 21 extend along the same circular arc when the two switching extensions 13, 23 congruently lie on top of one another. When the rotating direction is changed, the control flank 7' acts upon the crown regions of the switching extensions 13, 23, which are not in an overlapping position, so as to pivot the locking members 10, 20 relative to one another in such a way that the two switching extensions 13, 23 assume an overlapping position in an intermediate position, but are once again displaced from the overlapping position into a non-overlapping position during the further pivoting motion of the switching member 3.

The preceding explanations serve for elucidating all inventions that are included in this application and respectively enhance the prior art independently with at least the following combinations of characteristics, namely:

A screwing tool, which is characterized in that the locking members 10, 20 are two bodies that can be displaced relative to one another.

A screwing tool, which is characterized in that the locking members 10, 20 can be displaced relative to one another in an articulated manner, wherein the locking toothing 11, 21 of each locking member 10, 20 features teeth, which in an engaged position with the circumferential toothing 5 extend on a circular arc line around the axis a.

A screwing tool, which is characterized in that the locking members 10, 20 respectively feature a switching extension 13, 23, which protrude into the same switching recess 30 of a switching member 3.

A screwing tool, which is characterized in that the switching extensions 13, 23 are acted upon by a spring-loaded control flank 7' in such a way that only one of the two locking toothings 11, 21 is respectively engaged with the circumferential toothing 5 in the two switching positions, in which the rotatability of the drive output member 2 relative to the drive input member 1 is respectively blocked in a different rotating direction.

A screwing tool, which is characterized in that both locking toothings 11, 21 are simultaneously engaged with the circumferential toothing 5 when the switching member 3 is switched into an intermediate position.

A screwing tool, which is characterized in that the switching member 3 is for the directional reversal of the freewheel lock inserted into a bore of the drive input member 1, which allows a rotation of the switching member 3, by displacing the locking members 10, 20 in the azimuthal direction referred to the axis a from a locking interstice 17 into a locking interstice 27 lying opposite thereof in the azimuthal direction, wherein the locking interstices 17, 27 are formed by contact flanks 12, 22 and sections of the circumferential toothing 5.

A screwing tool, which is characterized in that the two locking members 10, 20 are tied to one another in an overlapping region 15, 25 by means of hook-type projections engaging into one another.

A screwing tool, which is characterized in that the switching member 3 features a switching plunger 7 that forms the control flank 7' and is acted upon by a switching spring 8.

A screwing tool, which is characterized in that the curved surface of the switching plunger 7 forming the control flank 7' engages on the end 14, 24 of the switching extension 13, 23 and/or that the switching spring 8 is supported on a detent plunger 9 and features a detent element 33, which in the switching position engages into a detent recess 31.

All disclosed characteristics are essential to the invention (individually, but also in combination with one another). The disclosure content of the associated/attached priority documents (copy of the priority application) is hereby fully incorporated into the disclosure of this application, namely also for the purpose of integrating characteristics of these documents into claims of the present application. The characteristic features of the dependent claims characterize independent inventive enhancements of the prior art, particularly for submitting divisional applications on the basis of these claims.

The invention claimed is:

1. A screwing tool with a directionally reversible freewheel lock, comprising a drive output member, which is mounted in a bearing eye of a drive input member so as to be rotatable about an axis and features a circumferential toothing and a drive output profile section, as well as locking members, which are inserted into a pocket of the drive input member and respectively feature a locking toothing for engaging into the circumferential toothing in a rotationally locking manner, wherein the locking members are two bodies that can be displaced relative to one another, wherein the two locking members are tied to one another in an overlapping region by means of hook-type projections engaging into one another.

2. The screwing tool according to claim 1, wherein the locking members can be displaced relative to one another in an articulated manner, wherein the locking toothing of each locking member features teeth, which in an engaged position with the circumferential toothing extend on a circular arc line around the axis.

3. The screwing tool according to claim 2, wherein the locking members respectively feature a switching extension, which protrude into a common switching recess of a switching member.

4. The screwing tool according to claim 2, wherein the two locking members are tied to one another in an overlapping region by means of hook-type projections engaging into one another.

5. The screwing tool according to claim 1, wherein the locking members respectively feature a switching extension, which protrude into a common switching recess of a switching member.

6. The screwing tool according to claim 5, wherein the switching extensions are acted upon by a spring-loaded control flank in such a way that only one of the two locking toothings is respectively engaged with the circumferential toothing in two switching positions, in which the rotatability of the drive output member relative to the drive input member is respectively blocked in a different rotating direction.

7. The screwing tool according to claim 6, wherein both locking toothings are simultaneously engaged with the circumferential toothing when the switching element is switched into an intermediate position.

8. The screwing tool according to claim 6, wherein the switching member is for the directional reversal of the freewheel lock inserted into a bore of the drive input member, which allows a rotation of the switching member, by displacing the locking members in the azimuthal direction referred to the axis from a locking interstice into a locking interstice lying opposite thereof in the azimuthal direction, wherein the locking interstices are formed by contact flanks and sections of the circumferential toothing.

9. The screwing tool according to claim 6, wherein the switching member features a switching plunger that forms the control flank and is acted upon by a switching spring.

10. The screwing tool according to claim 5, wherein both locking toothings are simultaneously engaged with the circumferential toothing when the switching element is switched into an intermediate position.

11. The screwing tool according to claim 5, wherein the switching member is for the directional reversal of the freewheel lock inserted into a bore of the drive input member, which allows a rotation of the switching member, by displacing the locking members in the azimuthal direction referred to the axis from a locking interstice into a locking interstice lying opposite thereof in the azimuthal direction, wherein the locking interstices are formed by contact flanks and sections of the circumferential toothing.

12. The screwing tool according to claim 1, wherein a switching spring is supported on a detent plunger and features a detent element, which in the switching position engages into a detent recess.

13. A screwing tool with a directionally reversible freewheel lock, comprising a drive output member, which is mounted in a bearing eye of a drive input member so as to be rotatable about an axis and features a circumferential toothing and a drive output profile section, as well as locking members, which are inserted into a pocket of the drive input member and respectively feature a locking toothing for engaging into the circumferential toothing in a rotationally locking manner, wherein the locking members are two bodies that are displaceable relative to one another, wherein the locking members respectively feature a switching extension, which protrude into a common switching recess of a switching member, wherein the switching extensions are acted upon by a spring-loaded control flank in such a way that only one of the two locking toothings is respectively engaged with the circumferential toothing in two switching positions, in which the rotatability of the drive output member relative to the drive input member is respectively blocked in a different rotating direction, wherein the switching member features a switching plunger that forms the control flank and is acted upon by a switching spring.

14. The screwing tool according to claim 13, wherein a curved surface of the switching plunger forming the control flank engages on the end of the switching extension.

15. The screwing tool according to claim 13, wherein the switching spring is supported on a detent plunger and features a detent element, which in the switching position engages into a detent recess.

16. A screwing tool with a directionally reversible freewheel lock, comprising a drive output member, which is mounted in a bearing eye of a drive input member so as to be rotatable about an axis and features a circumferential toothing and a drive output profile section, as well as locking members, which are inserted into a pocket of the drive input member and respectively feature a locking toothing for engaging into the circumferential toothing in a rotationally locking manner, wherein the locking members are two bodies that can be displaced relative to one another, wherein a switching spring is supported on a detent plunger and features a detent element, which in the switching position engages into a detent recess.

* * * * *